US010516936B1

(12) United States Patent
Lai et al.

(10) Patent No.: US 10,516,936 B1
(45) Date of Patent: Dec. 24, 2019

(54) SPEAKER

(71) Applicant: MERRY ELECTRONICS (SHENZHEN) CO., LTD., Guangdong (CN)

(72) Inventors: Tsai-Ti Lai, Taichung (TW); Chun-Pin Chen, Taichung (TW)

(73) Assignee: MERRY ELECTRONICS (SHENZHEN) CO., LTD., Guangdong (CN)

( * ) Notice: Subject to any disclaimer, the term of this patent is extended or adjusted under 35 U.S.C. 154(b) by 0 days.

(21) Appl. No.: 16/111,191

(22) Filed: Aug. 23, 2018

(30) Foreign Application Priority Data

Jun. 21, 2018 (TW) ..... 107121361 A

(51) Int. Cl.
*H04R 1/24* (2006.01)
*H04R 9/02* (2006.01)
*H04R 9/06* (2006.01)

(52) U.S. Cl.
CPC ..... *H04R 1/24* (2013.01); *H04R 9/025* (2013.01); *H04R 9/06* (2013.01); *H04R 2400/11* (2013.01)

(58) Field of Classification Search
CPC ... H04R 1/24; H04R 9/06; H04R 9/02; H04R 1/10; H04R 1/1075; H04R 5/033; H04R 1/008; H04R 1/1016; H04R 2205/022
USPC ..... 381/337, 334, 191, 333, 182, 190, 598, 381/396, 412, 309, 371; 181/99, 156
See application file for complete search history.

(56) References Cited

U.S. PATENT DOCUMENTS 6,487,297 B1 * 11/2002 Chin-Fa ..... H04R 1/345 381/345
6,574,347 B1 * 6/2003 Linse ..... H04R 7/045 381/152
2003/0123692 A1 * 7/2003 Ueki ..... H04R 1/44 381/398
2009/0190783 A1 * 7/2009 Yang ..... H04R 1/28 381/337

* cited by examiner

*Primary Examiner* — Melur Ramakrishnaiah
(74) *Attorney, Agent, or Firm* — CKC & Partners Co., LLC

(57) ABSTRACT

A speaker includes a frame and a partition wall coupled with the frame to define a boundary between a high-pitched sound zone and a low-pitched sound zone. The high-pitched sound zone includes an electromagnetic component accommodating area and plural discontinuous sound chamber extension areas. The electromagnetic component accommodating area and the plural discontinuous sound chamber extension areas are fluid-communicable.

14 Claims, 4 Drawing Sheets

SPEAKER

CROSS-REFERENCE TO RELATED APPLICATION

This application claims priority to Taiwan Application Serial Number 107121361, filed Jun. 21, 2018 which is herein incorporated by reference.

BACKGROUND

Field of Invention

The present disclosure relates to a speaker, and more particularly, to a speaker equipped with a high-pitched sound zone and a low-pitched sound zone.

Description of Related Art

Listening to music has become an indispensable part of modern life to regulate tension and monotony. Therefore, the sound quality of music produced by the speakers (such as speakers, headphones, etc.) of general consumer products and the experience of using the speaker to listening to music will affect consumption. As consumer demands for sound quality are also higher and higher, the requirements for speakers of general consumer products are increasingly taken care so as to improve the sound quality and the consumer experience.

Generally speaking, a speaker with a small volume, such as an earphone, is capable of accommodating single one sound-producing unit, which is difficult to simultaneously consider the sound experience of high-pitched and low-pitched sound. How to improve the output quality of high-pitched and low-pitched sound in smaller speakers is one of the focusing researches developed by speaker manufacturers.

SUMMARY

In one or more embodiments, a speaker includes a frame and a partition wall coupled with the frame to isolate a high-pitched sound zone from a low-pitched sound zone. The high-pitched sound zone includes an electromagnetic component accommodating area and plural discontinuous sound chamber extension areas.

In one or more embodiments, the electromagnetic component accommodating area is a circular area, and the plural discontinuous sound chamber extension areas are discontinuous sector area.

In one or more embodiments, the electromagnetic component accommodating area and the plural discontinuous sound chamber extension areas are fluid-communicated.

In one or more embodiments, the frame includes plural ribs interconnected to define a central through hole and plural side through holes.

In one or more embodiments, the central through hole is aligned with the electromagnetic component accommodating area.

In one or more embodiments, the plural discontinuous sound chamber extension areas cover the plural side through holes.

In one or more embodiments, the speaker further includes plural mesh sheets to cover the plural side through holes.

In one or more embodiments, each sound chamber extension area covers a corresponding one of the plural side through holes.

In one or more embodiments, each mesh sheet covers a corresponding one of the plural side through holes.

In one or more embodiments, the speaker further includes a mesh sheet disposed in a concave section defined by the electromagnetic component accommodating area and any immediately-two of the plural discontinuous sound chamber extension areas.

In one or more embodiments, the plural discontinuous sound chamber extension areas are of even numbers, and are averagely located on opposite sides of the electromagnetic component accommodating area.

In one or more embodiments, the partition wall includes a top wall and plural sidewalls, and the plural sidewalls has at least one vent hole.

In one or more embodiments, the partition wall has a flow-regulation member located over the at least one vent hole.

In one or more embodiments, the partition wall includes a top wall and plural sidewalls, and each of the plural sidewalls of the plural discontinuous sound chamber extension areas has at least one vent hole.

In sum, the speaker disclosed herein has a partition wall to serve as a boundary between the high-pitched sound zone and the low-pitched sound zone, which allows the high-pitched sound and the low-pitched sound to be transmitted to and around in their respective zones so as to avoid mixing the high-pitched and low-pitched sounds, which improves output quality for both sounds.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
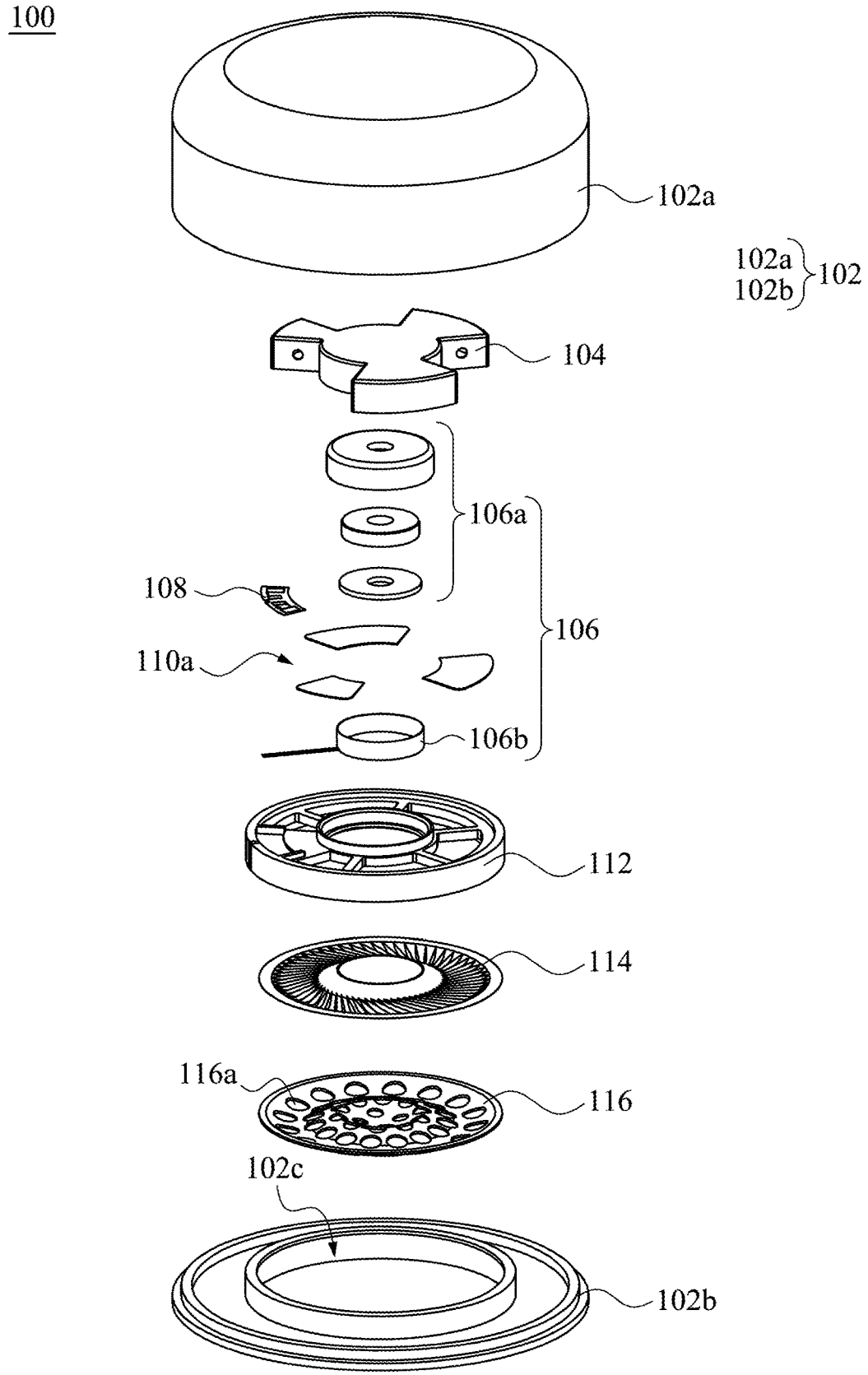
FIG. 1 illustrates an exploded view of a speaker according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

Reference is made to FIG. 1, which illustrates an exploded view of a speaker according to one embodiment of the present disclosure. A speaker 100 includes a partition wall 104, a frame 112, a diaphragm 114, a front cover 116, an electromagnetic component 106 and a housing 102, etc.

The electromagnetic component 106 includes a voice coil 106*b* and a magnetic part assembly 106*a* consisting of several components. The voice coil 106*b* is electrically connected to a driver circuit board 108 and is used to drive a diaphragm 114 vibrating to produce sound.

When all parts of the speaker are assembled, an outer rear cover 102*a* and a headset cover 102*b* are assembled to form the housing 102, which wraps the remaining components inside thereof. The front cover 116 is secured to a central opening 102*c* of the headset cover 102*b* and has plural sound output holes 116*a*.

Figure 2:
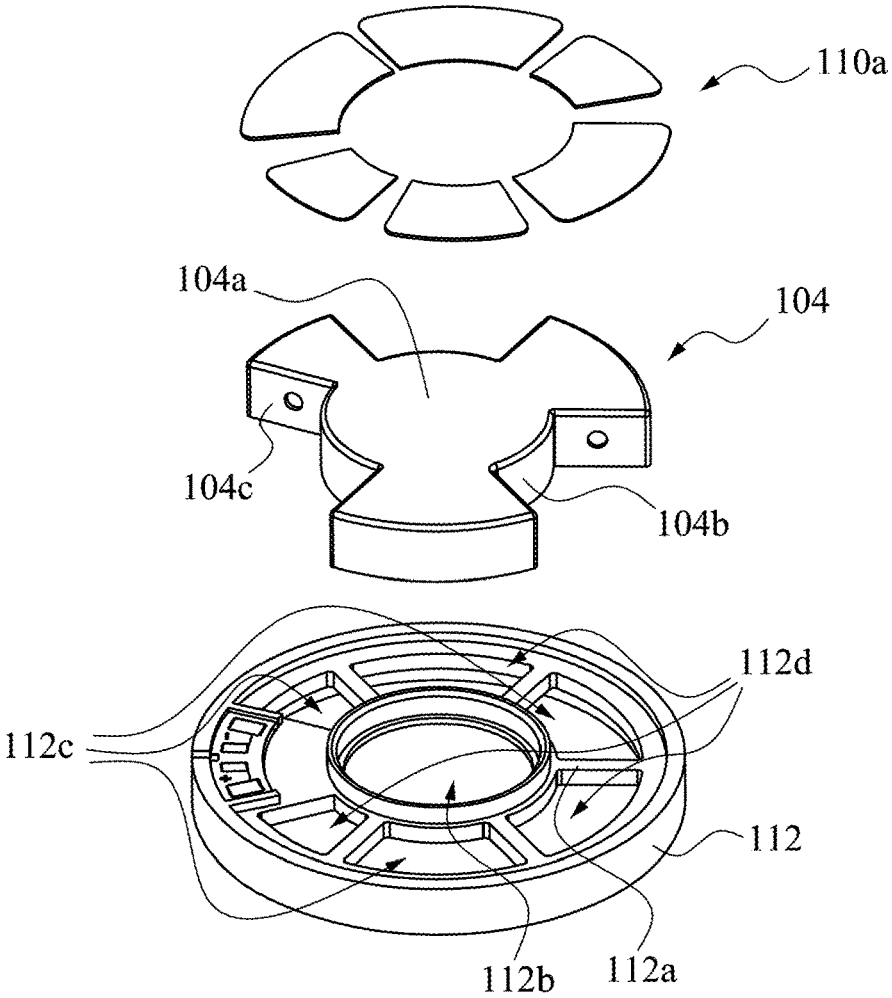
FIG. 2 illustrates a perspective view of some components of a speaker according to one embodiment of the present disclosure.

Reference is made to FIG. 2, which illustrates partition wall 104, mesh sheets 110*a* and a frame 112 of a speaker. The partition wall 104 is secured to the frame 112 to serve as a sound wave boundary between a high-pitched sound zone and a low-pitched sound zone, e.g., forming a boundary to isolate sound waves in the high-pitched sound zone from sound waves in the low-pitched sound zone.

The partition wall 104 basically consists of a top wall 104*a* and plural sidewalls. The plural sidewalls include flat sidewalls 104*c* and arc-shaped sidewalls 104*b*.

The frame 112 includes plural ribs 112*a* to define a central through hole 112*b* and plural side through holes (112*c*, 112*d*). When the partition wall 104 and the frame 112 are assembled, the partition wall 104 covers the central through hole 112*h* and the side through holes 112*c* of the frame 112. Plural mesh sheets 110*a* cover the side through holes (112*c*, 112*d*) of the frame 112, or the mesh sheets 110*a* the side through holes 112*c* which are uncovered and exposed by the partition wall 104.

In this embodiment of FIG. 2, an area sum of the plural side through holes 112*c* is equal to that of the plural side through holes 112*d*, but not being limited to.

Figure 3:
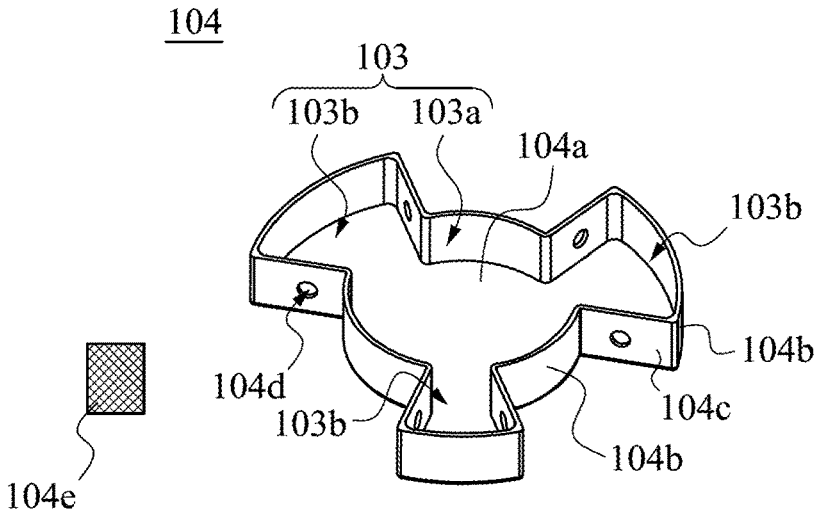
FIG. 3 illustrates a perspective view of a partition wall of the speaker as illustrated in FIG. 2.

Reference is made to FIG. 3, illustrates a perspective view of a partition wall 104 of the speaker in FIG. 2 from another view point. The high-pitched sound zone 103 wrapped around by the partition wall 104 includes an electromagnetic component accommodating area 103*a* and plural discontinuous sound chamber extension areas 103*b*. The electromagnetic component accommodating area 103*a* is configured to accommodate the electromagnetic component 106, and named after this function.

In this embodiment, the high-pitched sound zone 103 wrapped around by the partition wall 104 includes three discontinuous sound chamber extension areas 103*b*, and the electromagnetic component accommodating area 103*a* is a circular area while the plural discontinuous sound chamber extension areas 103*b* are discontinuous sector area, but not being limited to. For example, the electromagnetic component accommodating area and the plural discontinuous sound chamber extension areas comprise rectangular areas may be rectangular areas.

The electromagnetic component accommodating area 103*a* and the plural discontinuous sound chamber extension areas 103*b* of the high-pitched sound zone 103 are fluid-communicable, e.g., fluid may be flown from one sound chamber extension area 103*b* to another sound chamber extension area 103*b* via the electromagnetic component accommodating area 103*a*.

Figure 4:
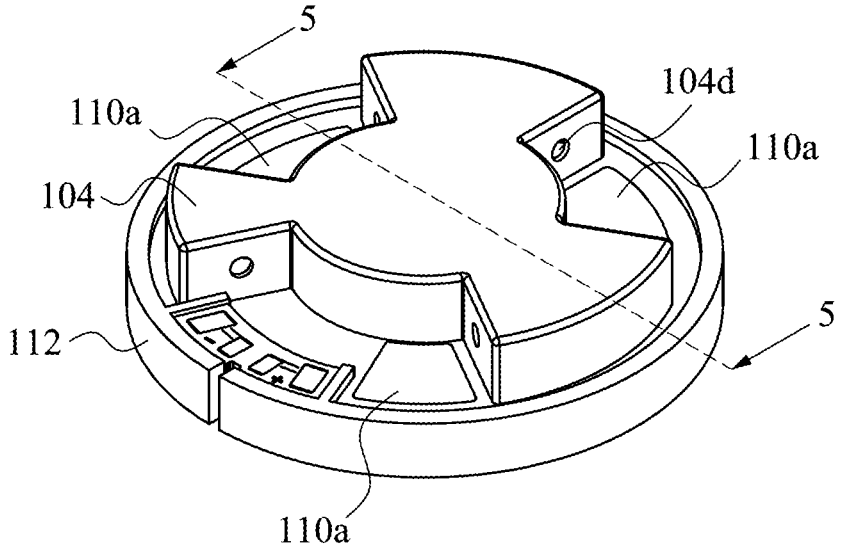
FIG. 4 illustrates a perspective view of a sound-producing unit within a speaker according to one embodiment of the present disclosure.

Reference is made to FIGS. 2, 3 and 4. FIG. 4 illustrates a perspective view of a sound-producing unit (with its housing removed) according to one embodiment of the present disclosure. When all parts of the speaker are assembled, the electromagnetic component accommodating area 103 of the high-pitched sound zone 103 is configured to cover the central through hole 112*b* of the frame 112, and the plural discontinuous sound chamber extension areas 103*b* of the high-pitched sound zone 103 are configured to cover the side through holes 112*c* and expose the remaining side through holes 112*d*.

Each side through hole 112*d* is located in a concave section defined by the electromagnetic component accommodating area 103*a* and any immediately-two of the plural discontinuous sound chamber extension areas 103*b*, and the mesh sheets 110*a* are used to cover the side through holes 112*d*.

In this embodiment, each sound chamber extension area 103*b* covers a corresponding one of the plural side through holes 112*c*, but not being limited to. For example, each sound chamber extension area may cover two or more side through holes.

In this embodiment, each mesh sheet 110*a* covers a corresponding one of the plural side through holes 112*d*, but not being limited to. For example, each mesh sheet may cover two or more side through holes.

In this embodiment, the sidewalls (104*b*, 104*c*) of the sound chamber extension area 103*b* have at least one vent hole 104*d*, and have a flow-regulation member 104*e* attached over the at least one vent hole 104*d*, e.g., the flow-regulation member 104*e* is attached to the sidewall to cover the vent hole 104*d*. Both flow-regulation member 104*e* and the mesh sheet 110*a* are porous ventilating members, which distribute airflow evenly between the high-pitched sound zone and low-pitched sound zone to maintain the air pressure consistently.

Figure 5:
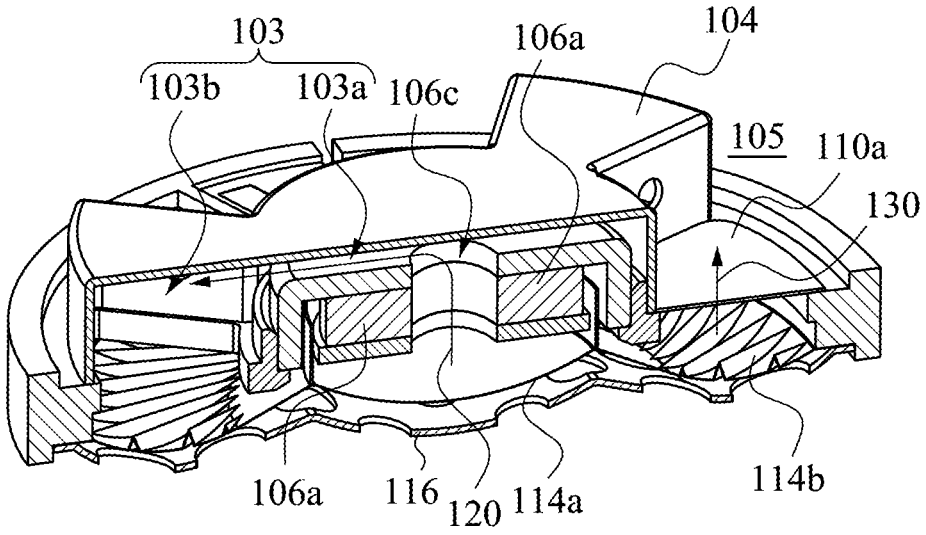
FIG. 5 illustrates a cross-sectional view of the sound-producing unit taken along the line 5-5 in FIG. 4.

Reference is made to FIGS. 4 and 5. FIG. 5 illustrates a cross-sectional view of the sound-producing unit taken along the line 5-5 in FIG. 4. The partition wall 104 forms a boundary between the high-pitched sound zone 103 and the low-pitched sound zone 105. The high-pitched sound zone 103 is a zone wrapped by the partition wall 104 and the diaphragm 114 while the low-pitched sound zone 105 is a zone wrapped by the partition wall 104, mesh sheets 110*a* and the housing 102 of the speaker (including the outer rear cover 102*a* and the headset cover 102*b*). In actual practice, the low-pitched sound zone 105 has a greater volume than that of the high-pitched sound zone 103, but not being limited to. The high-pitched sound zone 103 and low-pitched sound zone 105 are not entirely isolated by the partition wall 104, which have vent holes 104*d* and flow-regulation members 104*e* to distribute airflow evenly in both sound zones.

In this embodiment, a central section 114*a* of the diaphragm 114 produces a high-pitched sound transmitted along a direction 120 through a central hole 106*c* of the magnetic part assembly 106*a* and directed towards the electromagnetic component accommodating area 103*a* and plural discontinuous sound chamber extension areas 103*b* within the high-pitched sound zone 103. A peripheral area 114*b* of the diaphragm 114 produces a low-pitched sound transmitted along a direction 130 through the mesh sheets 110*a* and directed towards the low-pitched sound zone 105.

Figure 6:
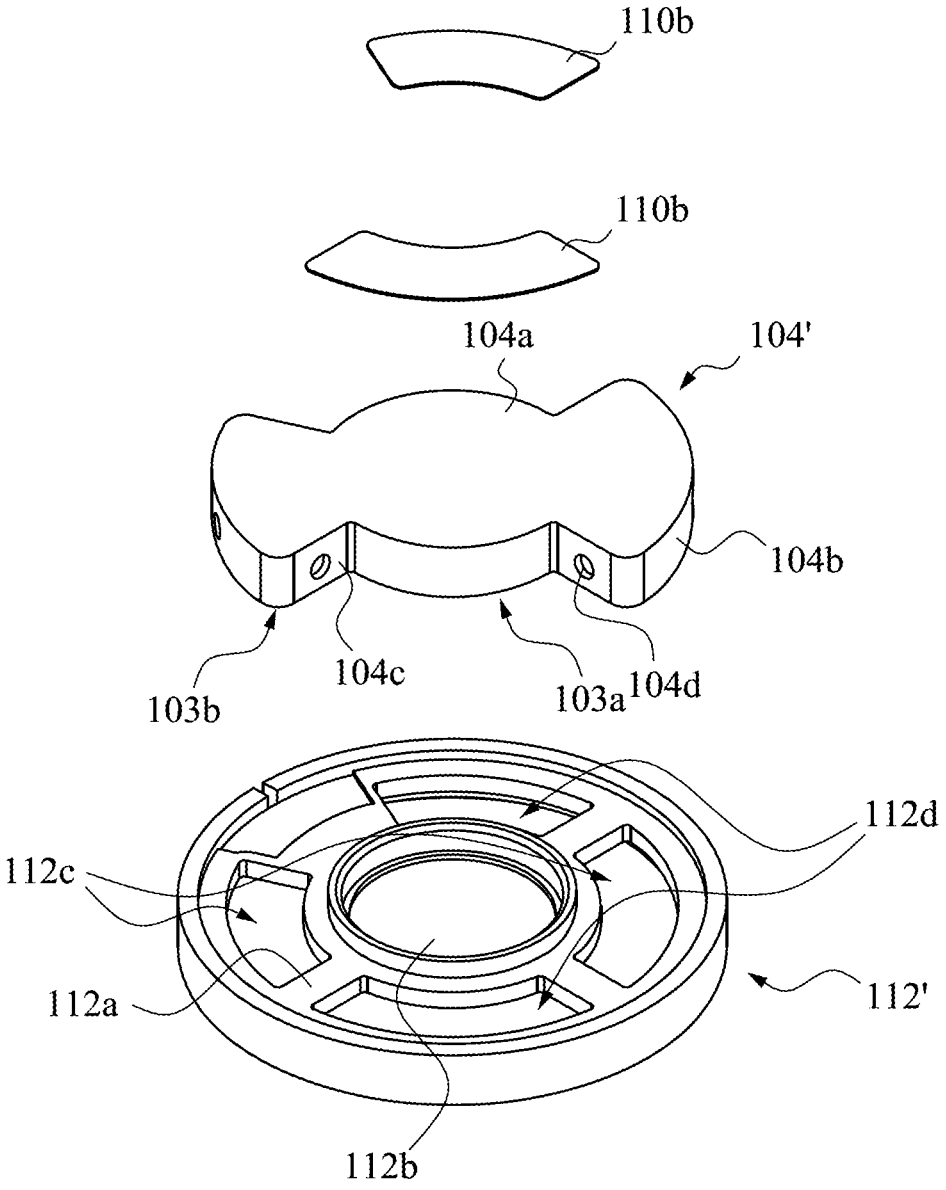
FIG. 6 illustrates a disassembled view of a partition wall, mesh sheets and a frame of a speaker according to another embodiment of the present disclosure.

In previous embodiment, the high-pitched sound zone 103 includes an electromagnetic component accommodating area 103*a* and three discontinuous sound chamber extension areas 103*b*, but not being limited to. For example, the high-pitched sound zone may include an electromagnetic component accommodating area and even numbers of discontinuous sound chamber extension areas that are averagely arranged on opposite sides of the electromagnetic component accommodating area, e.g., referring to the partition wall 104' and the frame 112' and mesh sheets 110*b* as illustrated in FIG. 6.

The high-pitched sound zone 103 wrapped around by the partition wall 104' includes an electromagnetic component accommodating area 103*a* and two plural discontinuous sound chamber extension areas 103*b* that are averagely arranged on opposite sides of the electromagnetic component accommodating area 103*a*. The electromagnetic component accommodating area 103*a* is aligned with and covers the central through hole 112*b* of the frame 112', and two discontinuous sound chamber extension areas 103*b* are aligned with and cover two side through holes 112*c* of the frame 112' respectively. Two remaining side through holes 112*d* of the frame 112' are covered by two mesh sheets 110*b* respectively, or the side through holes 112*c* of the frame 112' may be covered by the mesh sheets 110*b*. Both the mesh sheets 110*b* and the mesh sheets 110*a* are porous ventilating members.

In this embodiment, an area sum of two side through holes 112*c* is equal to an area sum of two side through holes 112*d*, but not being limited to.

In this embodiment, the sidewalls (104*b*, 104*c*) of the sound chamber extension area 103*b* (of the partition wall 104') have at least one vent hole 104*d*, and have a flow-regulation member, e.g., 104*e*, attached over the at least one vent hole 104*d*. The vent hole 104*d* may be formed on the flat sidewalls 104*c* or arc-shaped sidewalls 104*b*.

In sum, the speaker disclosed herein has a partition wall to serve as a boundary between the high-pitched sound zone and the low-pitched sound zone, which allows the high-pitched sound and the low-pitched sound to be transmitted to and around in their respective zones so as to avoid mixing the high-pitched and low-pitched sounds, which improves output quality for both sounds.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A speaker comprising:

a frame comprises plural side through holes; and a partition wall coupled with the frame to form a boundary between a high-pitched sound zone and a low-pitched sound zone, wherein the high-pitched sound zone comprises an electromagnetic component accommodating area and plural discontinuous sound chamber extension areas, wherein the partition wall covers corresponding ones of the plural side through holes and exposes remaining ones of the plural side through holes.

2. The speaker of claim 1, wherein the electromagnetic component accommodating area is a circular area, and the plural discontinuous sound chamber extension areas are discontinuous sector area.

3. The speaker of claim 1, wherein the electromagnetic component accommodating area and the plural discontinuous sound chamber extension areas comprise rectangular areas.

4. The speaker of claim 1, wherein the electromagnetic component accommodating area and the plural discontinuous sound chamber extension areas are fluid-communicable.

5. The speaker of claim 1, wherein the frame comprises plural ribs interconnected to define a central through hole and the plural side through holes.

6. The speaker of claim 5, wherein the central through hole is aligned with the electromagnetic component accommodating area.

7. The speaker of claim 5 further comprising plural mesh sheets to cover the plural side through holes.

8. The speaker of claim 7, wherein each mesh sheet covers a corresponding one of the plural side through holes.

9. The speaker of claim 1, wherein each sound chamber extension area covers a corresponding one of the plural side through holes.

10. The speaker of claim 1 further comprising a mesh sheet disposed in a concave section defined by the electromagnetic component accommodating area and any immediately-two of the plural discontinuous sound chamber extension areas.

11. The speaker of claim 1, wherein the plural discontinuous sound chamber extension areas are of even numbers, and are averagely disposed on opposite sides of the electromagnetic component accommodating area.

12. The speaker of claim 1, wherein the partition wall comprises a top wall and plural sidewalls, and the plural sidewalls comprise at least one vent hole.

13. The speaker of claim 12, wherein the partition wall has a flow-regulation member disposed over the at least one vent hole.

14. The speaker of claim 1, wherein the partition wall comprises a top wall and plural sidewalls, and each of the plural sidewalls of the plural discontinuous sound chamber extension areas comprises at least one vent hole.

* * * * *